United States Patent [19]

Gersbacher

[11] 3,953,016

[45] Apr. 27, 1976

[54] BRAZE FIXTURE

[75] Inventor: Harry C. Gersbacher, Dayton, Ohio

[73] Assignee: United Aircraft Products, Inc., Dayton, Ohio

[22] Filed: Feb. 14, 1975

[21] Appl. No.: 549,879

[52] U.S. Cl. ..... 269/236; 269/258; 269/267

[51] Int. Cl.[2] ..... B25B 1/24

[58] Field of Search ..... 269/265–267, 217, 229, 269/233–236, 258, 86; 81/180 B, 186

[56] References Cited

UNITED STATES PATENTS

| | | | |
|---|---|---|---|
| 447,526 | 3/1891 | Plischke et al. | 269/233 |
| 1,059,545 | 4/1916 | Kunze | 269/258 |
| 1,063,332 | 6/1913 | Diehl | 269/267 |
| 1,175,400 | 3/1916 | Allison et al. | 81/180 B |
| 1,182,780 | 5/1916 | Limpert | 269/258 |
| 1,203,152 | 10/1916 | Steudner | 269/258 |
| 1,226,715 | 5/1917 | Smithson | 269/229 |
| 1,397,409 | 11/1921 | Duwelius | 269/267 |
| 1,453,045 | 4/1923 | Förster | 269/267 |

*Primary Examiner*—Al Lawrence Smith
*Assistant Examiner*—Robert C. Watson
*Attorney, Agent, or Firm*—J. E. Beringer

[57] ABSTRACT

A fixture for holding parts to be joined together featuring clustered arrangements of pressure applying members. An interconnected yet independent mounting of individual pressure applying members enables a distributed pressure to be applied over a contacted area of a work surface, irrespective of whether such area is flat or curved. Single point pressure is applied uniformly to multiple pressure points. In an illustrated embodiment, clusters of pressure applying members are suspended within a generally C-shaped fixture which includes a cam lever manipulative to apply and to release pressure effects.

21 Claims, 12 Drawing Figures

FIG-1
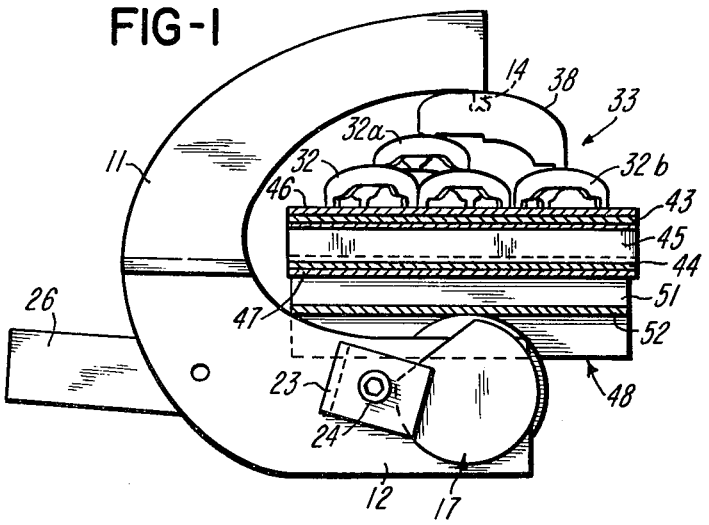
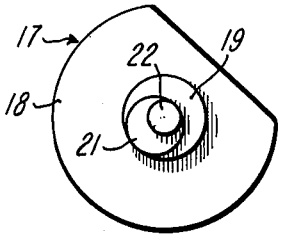
FIG-3
FIG-2
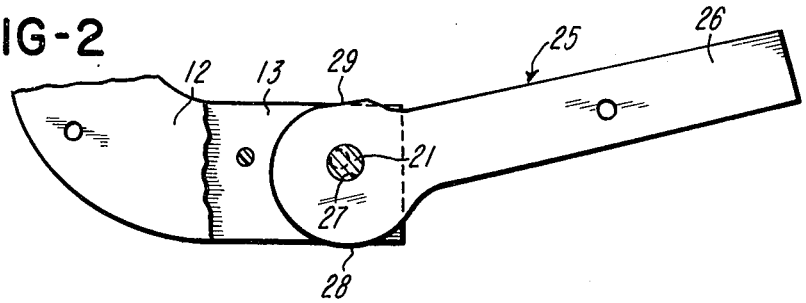
FIG-4
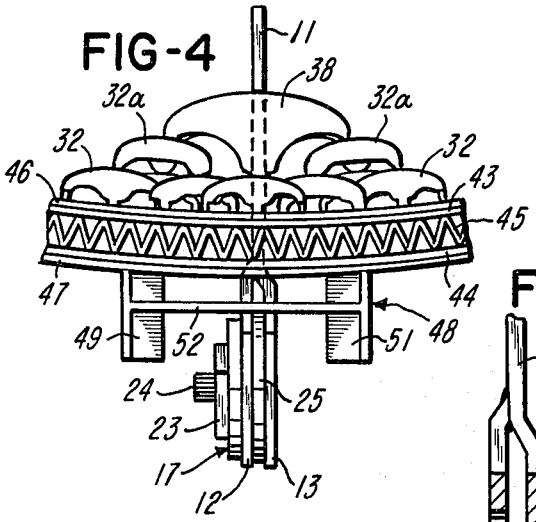
FIG-5
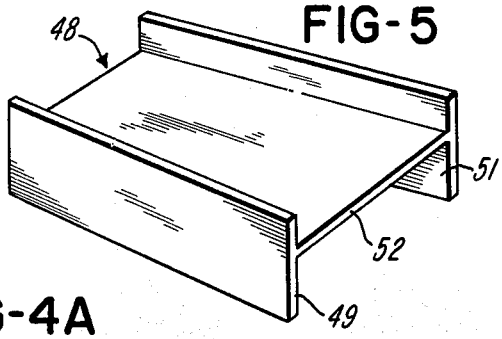
FIG-4A
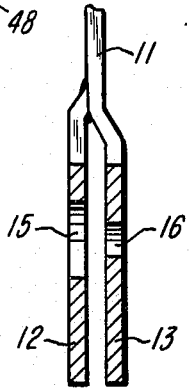
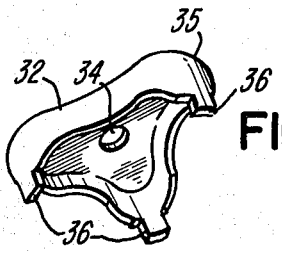
FIG-6

FIG-7
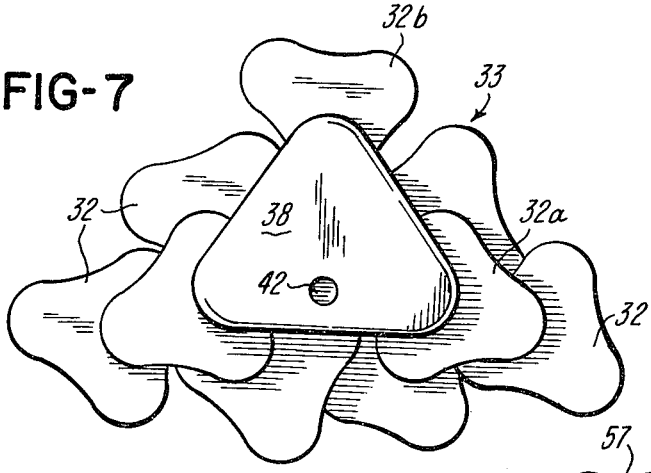
FIG-7A
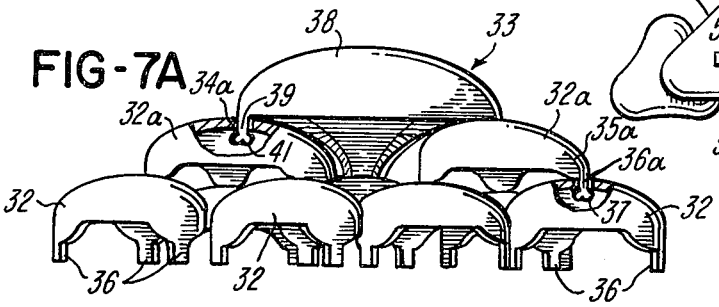
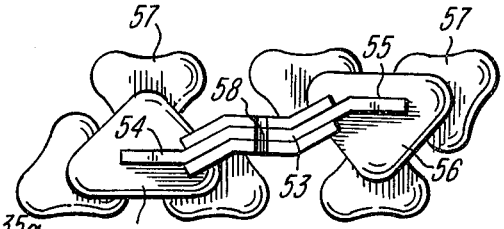
FIG-8
FIG-9
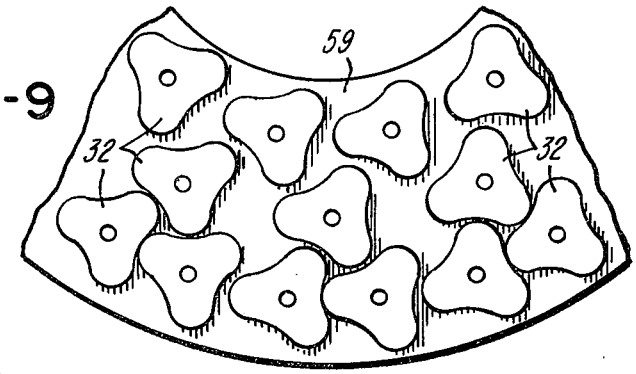
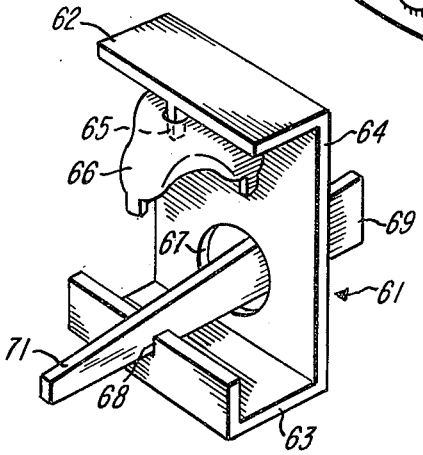
FIG-10

BRAZE FIXTURE

BACKGROUND OF THE INVENTION

Although not so limited, this invention has particular reference to the brazing of plate type heat exchangers where plates, spacer elements and extended surface fin means are stacked in an assembled relation and joined together in a furnace brazing, dip brazing or like operation. Preparatory to and during brazing the assembly of heat exchanger parts is held in a fixture, and it is toward improvements in this fixture that the instant invention, in its illustrative embodiment, is directed. Of especial concern are heat exchangers or other assemblies of parts which when assembled have an arcuate or curved configuration.

The purpose of the so-called braze fixture is not only to hold the parts in an assembled relation but to exert a holding pressure which is evenly distributed and uniformly applied. It is the objective to insure that in all affected joints the parts are in continuous contact with one another. In this manner the formation of tight, leak-free joints can reasonably be expected and the heat exchanger made strongly resistant to rupture from internal pressure. Plate type heat exchangers of substantial breadth or length, or both, pose special problems in this regard because of the length of involved joints. The use of relatively heavy flat plates as a part of the braze fixture has been known but these tend to bow when clamped and are not practicably constructed to the necessary precision of dimension. The use of hold down screws, in conjunction with superposing plates, is known but adjustment and readjustment of numerous screws is time consuming and no means exists for obtaining uniformity and continuity of adjustment. Where the assembly of parts to be held has an arcuate or curved form, problems of fixturing are particularly present since means have not heretofore been known for applying a uniform, distributed pressure to such surfaces.

SUMMARY OF THE INVENTION

The instant invention provides a braze fixture in which an accommodated assembly of parts can be gripped and released by actuation of a single means, obviating use of multiple screws and the like. Further, a concept of distributed, uniformly applied pressure is provided for in which pressure applied at a single location is transmitted uniformly and automatically to a plurality of other locations which are, or may be, nonlinear in arrangement. A braze fixture or the like according to the invention provides at least one seating surface. A hand operated lever or the like generates single point seating pressure and a plurality of pressure applying members utilizes the single point seating pressure to exert multiple point pressure urging the assembly of parts to the seating surface. The pressure applying members are in clusters of single or multiple form and individually are structured to cooperate with one another in extensive coverage of a work surface of given area. Multiple fixtures may be used to give complete coverage of a work assembly, as for example one defining a cone or segment thereof.

It is an object of the invention to provide a braze fixture characterized substantially as in the foregoing.

Other objects and structural details of the invention will appear from the following description when read in connection with the accompanying drawings, wherein:

FIG. 1 is a view in side elevation of a braze fixture in accordance with the illustrated embodiment of the invention, showing a work piece in the form of a heat exchanger held by the fixture, a cam lever comprised in the fixture being shown in a work holding position;

FIG. 2 is a fragmentary view in longitudinal section, showing the cam lever in another set position of adjustment;

FIG. 3 is a detail view of an eccentric mounting the cam lever;

FIG. 4 is a view in front elevation of the braze fixture, as applied to a work piece;

FIG. 4A is a sectional detail from FIG. 4;

FIG. 5 is a detail view of a pressure transmitting plate useful in a braze fixture;

FIG. 6 is a detail view of a pressure applying member;

FIG. 7 is a detail top plan view of the cluster arrangement of FIG. 1;

FIG. 7A is a side view partly broken away;

FIG. 8 is a top elevational view of a cluster arrangement useful alternatively or in conjunction with the arrangement of FIG. 5;

FIG. 9 is a top elevational view, in large part diagrammatic, showing cluster arrangements of braze fixtures as applied to a cone shaped work piece; and FIG. 10 is a detail view of a further form of fixture, showing a wedge operation.

Referring to the drawings, a braze fixture in accordance with an illustrated embodiment of the invention includes a generally C-shaped body 11, a lower part of which is bifurcated to be represented by a pair of spaced apart arms 12 and 13. An upper part of the body 11 has a fixed stud or tang 14 projecting toward the arms 12 and 13 and in a sense generally perpendicular thereto. Within the plane occupied by tang 14, the arms 12 and 13 have differentially sized through apertures 15 and 16 respectively. An eccentric mounting device 17 has a plate like portion 18 in a facial contact with arm 12. On what may be regarded as an inner side thereof, plate-like portion 18 has a concentric hub portion 19 rotatively received in aperture 15. Projected from hub 19 and radially offset from the axis thereof is an eccentric portion 21. Projecting from the latter, in the axis of hub 19, is a stud 22, the stud 22 being rotatively received in arm aperture 16. The device 17 is held in the position illustrated, with plate-like portion 18 seating flushly to arm 12, by a retention finger 23 releasably held by a screw stud 24. So positioned, eccentric portion 21 lies between arm 12 and 13.

A lever 25 also lies between the arms 12 and 13 and is formed toward one end with a handle portion 26. Near its other end, and in the axis of handle portion 26, lever 25 has a transverse through aperture 27 relatively rotatively receiving the eccentric portion 21. The defined other end of the lever is expanded about aperture 27, with its periphery describing the surface of a cam, respective high and low points 28 and 29 thereof being in an approximately opposing relation diametrally of aperture 27. The position and orientation of the parts is such that a swinging movement of the lever 25, to bring either high point 28 or low point 29 uppermost in the fixture, causes the cam periphery to move in senses approaching and withdrawing relatively to tang 14. There is a smoothly changing radius between the high and low points so that the cam surface progresses gradually and substantially uniformly from low point 29 to high point 28. The "throw" of the cam may be regulated by releasing pressure finger 23 and rotating device 17, this having the effect of rotatively adjusting eccentric portion 21 and causing the cam surface to ride higher or lower above arms 12 and 13. The lever 25 has a length exceeding the length of arms 12 and 13. Handle portion 26 always is accessible to effect a swinging movement of the lever and thereby a changing position of the cam surface which is a part of the lever.

Pressure applying members 32 position above the cam lever between upper and lower parts of the C-shaped body 11, and form part of a cluster 33 suspended from tang 14. Each member 32 is a formed element of an initial generally trianguar shape and having a central aperture 34. From aperture 34, the member is continuously curved in senses outwardly and downwardly and forms three rounded lobes 35. Each lobe 35 terminates in a tang or projection 36 occupying a plane parallel to the longitudinal axis of aperture 34. The tang 36 is used either as a pad for direct contact with the work or as a means to suspend other, like, members at their central apertures. In the present instance, parts identified as members 32 are in a lower level of the cluster so that tangs 36 thereof act as work engaging pads. Other parts **32*a* are identical to parts 32 but in the illustration instance act as intermediate suspension means. Thus, each lobe 35*a* of a member 32*a* has a dependent tang 36*a* received in the central aperture 34 of a respective member 32. After this insertion has been effected, the tip of each tang 36*a* is expanded, as by the addition of weld formations 37, so that the tang cannot be withdrawn. An aperture 34 is oversize relatively to a tang 36*a* and the thickness of a member 32 is substantially less than the length of a tang 36*a*. As a result, each member 32 is suspended with freedom of rotary and tilting motions relatively to the member 32*a* from which it is suspended and relatively to other members 32**.

Each lobe **35*a* of a member 32*a* suspends a member 32, and, in respect of the assembly here illustrated, forms therewith a sub-assembly or sub-cluster. In broad aspects, it may be considered that the invention is complete in the presence of a single pressure applying member and suspension means therefor. Ordinarily, however, members will be used in groups or clusters. In this connection, each member 32** is indented or recessed between its lobes. This provides for interfitting of companion members in the same cluster or sub-cluster and of members of adjacent clusters. Multiple pressure applying members may accordingly be put into a compact arrangement for a large number of contacts with the work in a given area.

In the illustrated instance there are two intermediate suspension means **32*a*. These are in turn supported or suspended by a three lobed member 38 having a configuration generally like that of members 32 and 32*a*. Each member 32*a* is supported from a respective lobe of member 38, the mode of suspension being substantially like that by which members 32 are suspended from a member 32*a*. Thus, at each of two lobes, the member 38 has a tang 39 projected into an aperture 34*a* in a member 32*a*, with weld material 41 being applied thereto. Members 32*a*, therefore, in addition to suspending members 32 of relative rotary and tilting movements, are themselves suspended for like relative motions from member 38. The third lobe of member 38 directly suspends a pressure applying member 32*b* identical to members 32. Further, such third lobe is relatively depressed to place member 32*b* substantially in the same horizontal plane as members 32**.

For a substantially balanced suspension of the cluster including members 32, **32*a* and 32*b*, the member 38 has an aperture 42 offset from its center toward a plane intersecting the centers of suspended members 32*a*. Aperture 42 receives tang 14, and member 38 is freely suspended thereby in substantially the same manner, and with the same freedom of motion that members 32*a* are suspended from member 38 and that members 32 are suspended from members 32*a***.

A device according to the invention is capable of functioning as a clamp to hold plural parts in a superposing, intimately contacting relation while work is being performed thereon. In a particular application, it serves as a braze fixture, holding stacked parts of a plate type heat exchanger in an assembled relation while they are being joined together in a brazing operation. The fixture is applied to the work with upper and lower parts of the C-shaped body 11 in an embracing relation thereto. An upper work surface is contacted by the cluster 33, or more particularly by the tangs dependent from members 32 and **32*b*. Either directly or indirectly, a lower work surface is contacted by the cam lever 25. The latter accordingly becomes a pressure generating and pressure release means, with the cluster 33 providing reactant pressure at multiple distributed points on an upper work surface. A characteristic of the fixture is its ability to function effectively whether the work surfaces are flat or curved. In the latter instance, the pressure applying members and suspension members of the cluster 33** make selfadjusting movements relative to the work and to one another with a uniform reactant pressure being applied at each tang or pad.

The work in the illustrated embodiments is a plate type heat exchanger including spaced apart plates 43 and 44 between which is a corrugated strip or fin 45 of a heat conductive material. The fin connects the plates and acts as secondary heat transfer surface. A finished heat exchanger structure finds the plates 43 and 44 united with the fin 45 to form a one-piece unitary device. In the uniting process, accomplished by brazing, it is desirable that the peaks and valleys of the fin have an uninterrupted joinder to overlying and underlying plates. In this way, good heat conductivity is assured and continuous ties are formed negating the efforts of internal pressure to separate the plates from the fin. In the illustrated instance, the braze fixture is shown applied to a segment of a cone-shaped heat exchanger, the segment being arcuate in form and in actual embodiment describing a closed circular shape. A plurality of braze fixtures is applied to the circular segment, mounting in a sense radially thereof. Pressure applying members 32 make numerous, closely spaced contact with what may be regarded as an upper work surface and urge the work tightly against respective cam levers 25, with fin 45 being squeezed between plates 43 and 44. Brazing may be carried out in any of the known methods, including furnace brazing where temperature and environmental conditions can be closely controlled.

In fixturing, plates 46 and 47 are applied above and below the heat exchanger. These protect the plates 43 and 44 from direct contact by the cluster and by cam lever 25, and, in addition, assist in more uniformly disturbing applied pressures. Also, in fixturing there desirably is used a pressure plate 48 comprised of vertical side rails 49 and 51 and an interconnecting horizontal wall 52. The latter is fixed intermediate upper and lower edges of the side rails. The parts have a tapering configuration in keeping with the application of the fixture to a coneshaped work piece. The pressure plate 48, in use, fits endwise over the lower part of body 11 with wall 52 resting on or in position to be engaged by cam lever 25. In applying the fixture to the work, the upper edges of rails 49 and 51 contact the underside of the work assembly, which in the illustrated instance is represented by plate 47. Assuming lever 25 to be in a released position, there will at this time be an absence of pressure in the fixture, with pressure applying members 32 contacting upper plate 46 lightly or not at all. Swinging the lever from a release position toward a pressure applying position brings the gradually rising cam surface on lever 25 to bear on wall 52 and raises the assembly comprising plate 48 and the heat exchanger segment into motion limiting engagement with the cluster 33. The relationship of the parts ordinarily will be predetermined so that a swinging movement of the lever 25 through an arc of 180° will move it alternately to positions of full release and full pressure. Eccentric 18 may be adjusted to assist in obtaining a correct application of pressure, and an adequate release of pressure in the positional extremes of the cam lever. Other plates 48 may be substituted in the fixture. The spread apart rails 49 and 51 aid in furnishing a pressure opposite to the clusters 33 which is in a more directly opposing relation.

The tangs 36*a* on the members 32*a*, and the tangs 39 on the member 38, terminate at their bases in abutment shoulders. Pressure of the work against the members 32 effects a conforming, tilting movement of the members and at the same time a bodily lifting motion thereof seating the members to the abutment shoulders on members 32*a*. Continued pressure lifts members 32*a* to limit against abutment shoulders on member 38, and still further applied pressure seats member 38 to body 11 at the base of tang 14. The final result is a substantially rigid structure, fully adapted to the curvature of the work and applying a uniform, distributed pressure thereto.

A cluster of pressure applying members and suspension means therefor may take forms other than that illustrated in FIGS. 1, 4 and 7. For example, a suspension means like means 38 may have a cluster of pressure applying members suspended from only one lobe thereof and single members suspended from the other lobes. Also, sub-clusters as represented by a member 32*a* and suspended members 32 may be interconnected by rigid bar means or the like. The latter construction is shown in FIG. 8 where a rigid bar means 53 has an irregular configuration providing offset terminals 54 and 55. These have dependent tangs (not shown) which suspend intermediate members 56 in the same manner that the lobes of means 38 suspend members 32*a* and 32*b*. Members 56 have a triangular configuration and suspend pressure applying members 57 in the same manner that members 32*a* suspend members 32. At its mid point, bar means 53 has a slotted and recessed configuration 58 by which it may be fit to the upper arm of a fixture body, such as the body 11 with its tang 14.

Variations of both described forms of the invention are, of course, possible to obtain a more closely spaced or different arrangement of cluster applying members. FIG. 9 illustrates diagrammatically what might be regarded as a typical application of the invention. An annular work assembly 59 has a cone-like configuration. Multiple fixture bodies 11 are applied to the work by being moved into an embracing relation thereto over the outer edge of the work. The several bodies are in a radial orientation and in a relatively closely spaced side by side arrangement. In accordance with the length of the conical segment, degree of curvature, and other factors, the fixture bodies are equipped with suspended clusters selected to give the greatest possible coverage of the work surface. In this connection, it will be seen in FIG. 9 how the indented configuration of the pressure applying members provides for interfitting and thereby for a more compact arrangement and more extended contact with the work surface. In the illustrated instance the clusters diagrammatically shown are multiples of and partial showings of the cluster 33. It will be evident, however, that other clusters and combinations of clusters may be used, as the work may require.

It may in some instances be desirable to substitute the straight line action of a wedge for that of a rotary cam, in applying and releasing a work holding pressure. Such an arrangement is shown in FIG. 10, where a body 61 has overlying and underlying arms 62 and 63 and an interconnecting vertical wall 64. A dependent tang 65 suspends a pressure applying member 66 which is illustratively representative of any of the individual members or clusters of members heretofore discussed. In the wall 64 is an opening 67. In an upturned portion of arm 63 is a slot 68. A member 69 is reciprocable in opening 67 and is guided in such movement by virtue of being received in slot 68. An upper edge 71 of member 69 is inclined. Assuming a work piece to be received in body 61, between the members 66 and 69, it will be evident that a reciprocable movement of member 69 will result in pressure applying and releasing action as inclined edge 71 moves relatively to the work. A pressure applying plate, like the plate 48, may be used intermediate the members 69 and the work if found necessary or desirable.

In all illustrated instances, a cluster has been disclosed as suspended for the application of reactant pressures. It will be evident, however, that the relationship of parts can be reversed, with overlying cluster supporting means being movable and underlying support means providing the reactant pressure.

The invention has been disclosed with respect to particular embodiments. Structural modifications have been discussed and these and others obvious to a person skilled in the art to which this invention relates are considered to be within the intent and scope of the invention.

What is claimed is:

1. A braze fixture, including a plurality of like pressure applying members, each providing a triangular arrangement of work contacting downwardly projecting pads, said pressure applying members being arranged in a triangular grouping, a single means commonly suspending said plurality of pressure applying members at a location intermediately of their respective pads with individual freedom of relative tilting motion, said single means and said plurality of pressure applying members forming a pressure applying cluster, and means for supporting said cluster for application therethrough of direct or reactant pressures.

2. A braze fixture according to claim 1, characterized by a plurality of pressure applying clusters, and other means commonly suspending said clusters, said other means suspending respective said single means with freedom of relative tilting motion.

3. A braze fixture according to claim 1, wherein said pressure applying members each forms part of a further pressure applying cluster, further pressure applying members being suspended from respective pads of each of the first said pressure applying members with freedom of relative tilting motion.

4. A braze fixture according to claim 1, wherein each of said pressure applying members is apertured at its center and said single means having spaced apart downwardly projecting portions received in respective apertured centers and suspending respective pressure applying memebers for freedom of relative tilting and rotary movements.

5. A braze fixture according to claim 1, wherein said plurality of pressure applying members tend to position in a substantially common horizontal plane with each being tri-lobal and being indented or recessed between adjacent lobes so that said members may be placed in a closely assembled relation with the lobes of adjacent members being adapted to interfit.

6. A braze fixture according to claim 1, wherein said single means is mounted in said suporting means for relative tilting motion.

7. A braze fixture according to claim 2, wherein said other suspending means is mounted in said supporting means for relative tilting motion.

8. A braze fixture according to claim 2, wherein said plurality of clusters is in a closely assembled relation with each pressure applying member indented or recessed between pad locations, with the pressure applying members of one cluster being adapted to interfit with the pressure applying members of another cluster.

9. A braze fixture according to claim 1, wherein each of said pressure applying members has a generally triangular configuration to provide three spaced lobes, said member having an aperture at its center and curving continuously from said aperture in senses outwardly and downwardly thereof, said member between its lobes having an indented or recessed shape.

10. A braze fixture according to claim 1, wherein said means for supporting said cluster is an approximately C-shaped member, an assembly of parts to be fixtured for brazing being received between overlying and underlying arms thereof, characterized in that said pressure applying cluster is suspended from an overlying arm, and by means for effecting relative motion between said cluster and an underlying assembly of parts to fix said assembly between said arms,, with said pressure applying members applying a distributed pressure thereover.

11. A braze fixture according to claim 10, characterized by a cam lever mounted for oscillatory motion in said underlying arm and providing said means for effecting relative motion.

12. A braze fixture according to claim 2, wherein said other suspending means is a bar means formed intermediate its ends with means to interengage with said means for supporting said cluster.

13. A braze fixture according to claim 2, wherein said other suspending means is a multi-lobed means having a pressure applying cluster suspended from at least certain of the lobes thereof, and said means for supporting said cluster interengaging with said other suspending means at a location to obtain a balanced suspension of said pressure applying clusters.

14. A braze fixture according to claim 1, wherein said means for supporting said cluster is a body having overlying and underlying arms and an interconnecting substantially vertical wall, said pressure applying cluster being suspended from an overlying arm, and a wedge member mounted in said wall and said underlying arm for substantially linear movement relative to said body and to said cluster and presenting an inclined surface to said cluster.

15. A braze fixture according to claim 2, wherein said other means has a single point support from said means for supporting said cluster.

16. A braze fixture, including a pressure applying member having a generally triangular configuration to provide three general equally spaced lobes, tang means dependent from each lobe, and means for suspending said member substantially at a center location thereof for freedom of relative tilting motion, said tang means serving alternatively as work contacting pads or as suspension means for other pressure applying members to form therewith a cluster of such members.

17. A braze fixture according to claim 16, wherein said pressure applying member curves continuously from said center location in senses outwardly and downwardly thereof, said member between its lobes having an indented or recessed shape.

18. A braze fixture according to claim 16, wherein said means for suspending said member provides a triangular arrangement of dependent tang means, like pressure applying members being suspended from each said dependent tang means to form a cluster therewith.

19. A braze fixture according to claim 18, wherein said like pressure applying members are configured to facilitate interfitting one with another.

20. A braze fixture according to claim 19, characterized by means for suspending like clusters in a side by side adjacent relation, pressure applying members of companion clusters being adapted to interfit.

21. A braze fixture according to claim 1, characterized by a body providing said supporting means, a wedge member supported by said body for relative sliding motion, and means movable in a generally opposed relation to said supporting means adjustable in response to reciprocation of said wedge member.

* * * * *